US005333472A

United States Patent [19]

Bae et al.

[11] Patent Number: 5,333,472

[45] Date of Patent: Aug. 2, 1994

[54] AIR CONDITIONER WITH HEATER FOR HEATING LIQUIFIED REFRIGERANT

[75] Inventors: Young D. Bae, Suwon; Jin B. Kim, Chungchongbuk-Do, both of Rep. of Korea

[73] Assignee: Samsung Electronics Co., Ltd., Suwon, Rep. of Korea

[21] Appl. No.: 81,162

[22] Filed: Jun. 25, 1993

[30] Foreign Application Priority Data

Jun. 29, 1992 [KR] Rep. of Korea ..... 1992-11749[U]

[51] Int. Cl.[5] ..... F25B 43/00

[52] U.S. Cl. ..... 62/503

[58] Field of Search ..... 62/503, 509, 83; 165/29, 163

[56] References Cited

U.S. PATENT DOCUMENTS 2,775,683 12/1956 Kleist ..... 62/83 X
4,895,203 1/1990 McLaren ..... 165/163 X

FOREIGN PATENT DOCUMENTS 1-184373 7/1989 Japan ..... 62/503
2-298770 12/1990 Japan ..... 62/503

*Primary Examiner*—Harry B. Tanner
*Attorney, Agent, or Firm*—Burns, Doane, Swecker & Mathis

[57] ABSTRACT

An air conditioning system includes a compressor, and indoor and outdoor heat exchangers. During a heating cycle, when the refrigerant exiting the outdoor heating exchanger comprises a mixture of gaseous and liquid refrigerant, that mixture is passed through an accumulator in which the flow speed of the refrigerant is reduced, and in which the refrigerant is heated to convert the liquid refrigerant to gaseous refrigerant.

2 Claims, 4 Drawing Sheets

AIR CONDITIONER WITH HEATER FOR HEATING LIQUIFIED REFRIGERANT

BACKGROUND OF THE INVENTION

This invention relates to a cooling/heating air conditioner, and more particularly, to the auxiliary heating apparatus of an air conditioner provided to more effectively heat a room during the heating cycle.

A cooling/heating air conditioner which, in general, comprises an expansion tube, an outdoor heat exchanger, a four-way valve, a compressor, and an indoor heat exchanger; said air conditioner performs room-cooling in summer and room-heating in winter as determined by the four-way valve.

As shown in FIG. 1, which is a system diagram of a conventional air conditioner, refrigerant is circulated in the direction of the arrow: solid line to indicate a cool room in summer and broken line to indicate a heated room in winter.

This is achieved by means of the four-way valve, that is, if the flow direction of the refrigerant is reversed by the switch-over of the four-way valve during the cooling cycle which circulates in the direction of the solid line, the cooling/heating air conditioner is operated in the heating cycle as the function of the outdoor heat exchanger is changed to that of a condenser from that of an evaporator and the function of the indoor heat exchanger is changed to that of an evaporator from that of a condenser.

The heating cycle may be better understood by referring to FIG. 1. Initially, refrigerant in a gas state compressed to high temperature and high pressure by a compressor 1 is introduced to the indoor heat exchanger 5 through a four-way valve 2 to be heat-exchanged with indoor air and it then flows into expansion tubes 4 and 41 after being changed into a liquid state.

The refrigerant in the liquid state is expanded to a low temperature and low pressure while it passes through the expansion tubes 4 and 41 and then is introduced to the outdoor heat exchanger 3 to be heat-exchanged with the outdoor air.

The refrigerant which is changed into the mixed state of gas and liquid as a result of the heat exchange in the outdoor heat exchanger 3 passes through an accumulator 6 which allows only refrigerant in a gas state to pass so that the compressor 1 receives only refrigerant in a gas state. The air conditioner provides heat to a room by sequentially repeating the above process.

However, the heating capability of the conventional cooling/heating air conditioner is decreased as the outdoor air temperature falls during the heating cycle because the refrigerant directed to the outdoor heat exchanger 3 is not able to absorb sufficient heat from the cold outdoor air, and to make matters worse, if the outdoor air temperature falls below approximately 5 deg. C., the room-heating by the air conditioner becomes greatly impaired.

As a method to solve the above problem, an auxiliary heating apparatus 17 is mounted on the refrigerant pipe 51 between the outdoor heat exchanger 3 and the compressor 1 so as to heat the refrigerant when the outdoor temperature falls below a fixed temperature setting.

The auxiliary heating apparatus 17, as shown in FIG. 2, is assembled in the following order: heating coils 171 are wound around the peripheral portion of the refrigerant pipe 51, the heating coils 171 are enclosed within a flexible tube 172, both ends of the flexible tube 172 are sealed with a sealing member 175 such as silicone, and caps 175*a* are fitted on both of the ends. Power cords 180, 181 are connected to the heating coils.

But, the conventional air conditioner having the auxiliary heating apparatus 17 is not able to offer a desired heating effect because the velocity of the refrigerant passing through the refrigerant pipe 51 is relatively fast so that there is not enough time to achieve a sufficient heat exchange between the refrigerant and the heating coils 171.

Further more, the auxiliary heating apparatus 17 is mechanically unstable and its assembly is somewhat complicated because the auxiliary heating apparatus 17 is constructed in such a way that the caps 175*a* are forced to fit on the ends of the flexible tube 172 enclosing the heating coils 171.

SUMMARY OF THE INVENTION

An object of this invention is to provide a cooling-/heating air conditioner which is able to normally perform the room-heating function even when the outdoor air temperature becomes so low that the outdoor air is not heat-exchanged with refrigerant in the outdoor heat exchanger during the heating cycle.

Another object of this invention is to provide a cooling/heating air conditioner in which the speed of the refrigerant is reduced slow in an auxiliary accumulator equipped with an auxiliary heating apparatus in order for the refrigerant to have enough time to sufficiently absorb the heat generated by the auxiliary heating apparatus.

This invention comprises an auxiliary accumulator, which is provided between a four-way valve and the inlet of a compressor, in order to both selectively pass only refrigerant in a gas state after being separated from liquid refrigerant and reducing down the speed of the refrigerant therein, and an auxiliary heating apparatus which is mounted on the peripheral surface of the auxiliary accumulator for heating the refrigerant which does not absorb sufficient heat from the outdoor air in an outdoor heat exchanger during the heating cycle performed when the outdoor air has a low temperature, and thereby increasing the heating effect of the air conditioner.

The aforementioned auxiliary accumulator, which consists of a long cylindrical shape, has a much larger diameter than that of the refrigerant pipe and therefore reduces the speed of the refrigerant in the auxiliary accumulator.

The refrigerant pipe is inserted through one end of the auxiliary accumulator and is positioned so that it extends to near the opposite end of the auxiliary accumulator.

Further more, the auxiliary heating apparatus includes heating coils which are wounded around the peripheral surface of the auxiliary accumulator to heat the refrigerant, and a pair of covers separated into the upper and lower covers, respectively. Sealing members are arranged in the outer ends of each cover, and power cords electrically connected to the heating coils are drawn out of the outer ends of the covers. The inner ends of each cover which are placed face to face with each other are fitted with engaging members.

A cooling/heating air conditioner having the aforementioned apparatuses for heating the refrigerant performs the room-heating function during the heating cycle by continuously repeating the following process: the refrigerant is directed in sequence from the compressor to a four-way valve, an indoor heat exchanger which serves as a condenser, expansion tubes, an outdoor heat exchanger which serves as an evaporator whereby the refrigerant is heat-exchanged with outdoor air, the four-way valve, and back to the compressor.

If the outdoor temperature falls low below a fixed value, the auxiliary heating apparatus, which is mounted on the auxiliary accumulator positioned between the four-way valve and the inlet of the compressor, is charged with electricity by signals generated by a control section in order to heat the heating coils.

Further, the auxiliary accumulator having a larger diameter than that of the refrigerant pipe separates liquid refrigerant into either a gas or a liquid, and allows only the refrigerant in the gas state to go to the compressor.

Because the diameter of the auxiliary accumulator is larger than that of the refrigerant pipe, the speed of the refrigerant in the auxiliary accumulator becomes so slow that there is enough time to heat the refrigerant. Additionally, more length of heating coil is able to be wound around the auxiliary accumulator than in the conventional heating apparatus.

In addition, the liquid refrigerant in the auxiliary accumulator can be easily converted into a gas state by the heating coils so that a sufficient amount of the refrigerant is circulated within the refrigerant pipes.

For the above reason, the air conditioner utilizing this invention is able to normally perform the heating cycle, even when the outdoor temperature is low, becomes a sufficient amount of the refrigerant in gas state is directed to the compressor to compress it to make high temperature and pressure.

Moreover, the auxiliary accumulator and heating apparatus offer reliable workability and stability because they have simple and durable design and construction.

BRIEF DESCRIPTION OF THE DRAWINGS

For a better understanding of the invention as well as other objects and additional features thereof, reference is made to the following description which is to be read in conjunction with the accompanying drawings wherein.

DETAILED DESCRIPTION OF PREFERRED EMBODIMENT

Figure 1:
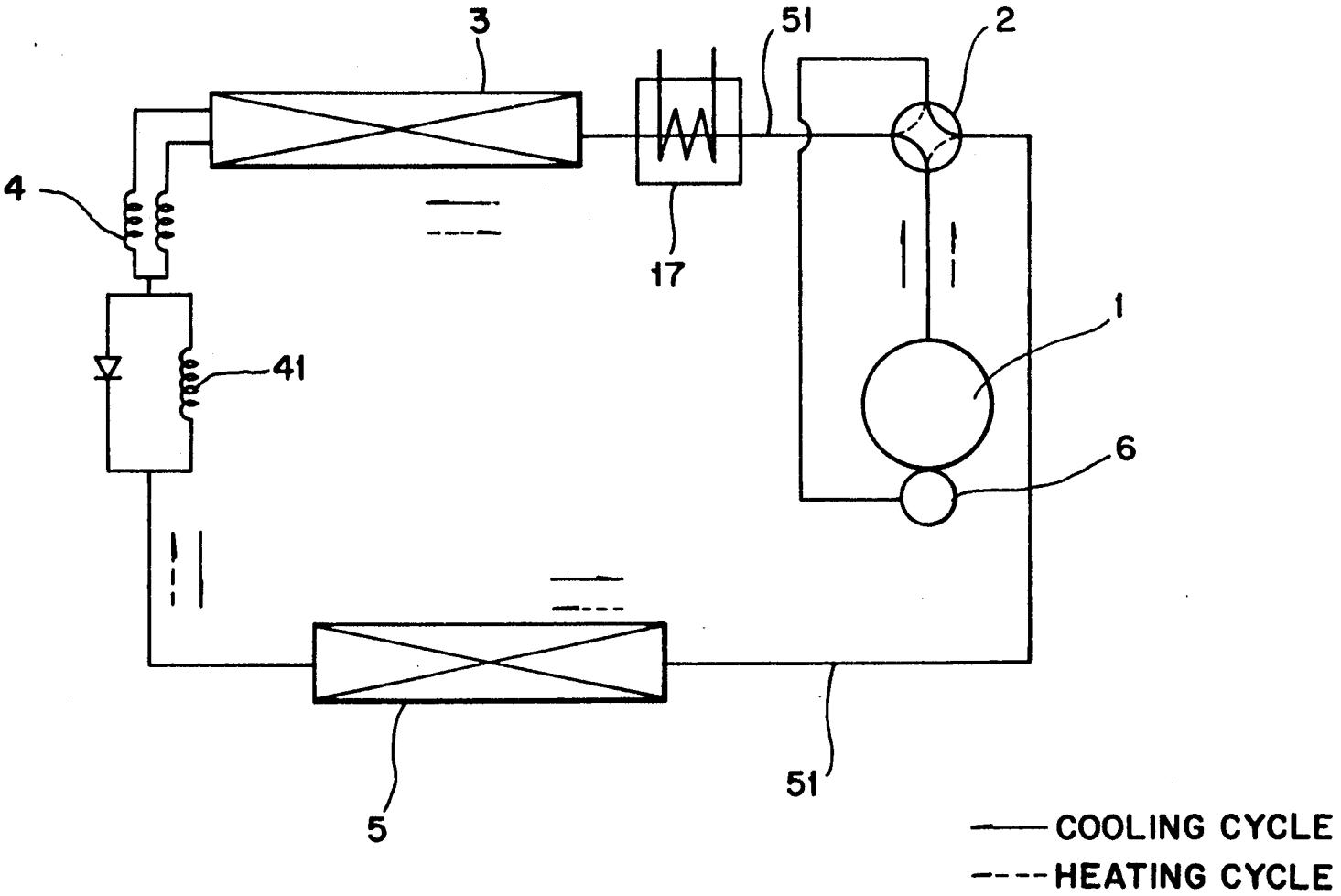
FIG. 1 (PRIOR ART)
FIG. 1 is a system diagram of a conventional cooling-/heating air conditioner.
Figure 2:
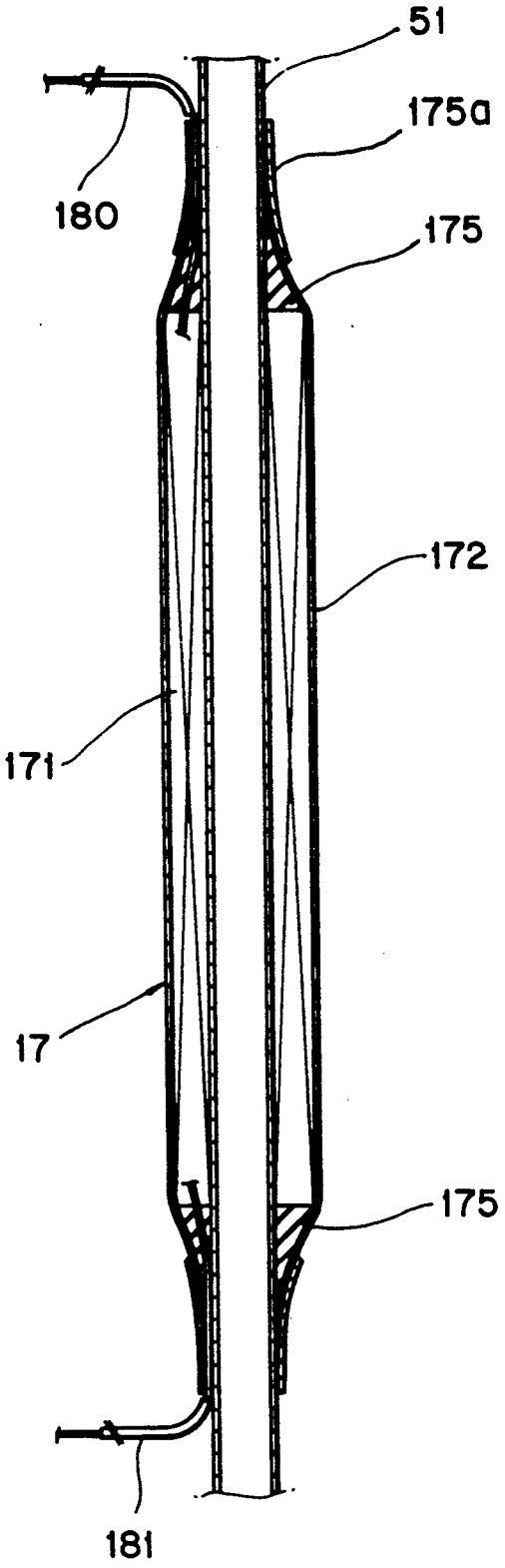
FIG. 2 (PRIOR ART)
FIG. 2 is a cross-sectional view of a conventional auxiliary heating apparatus mounted on a refrigerant pipe.
Figure 3:
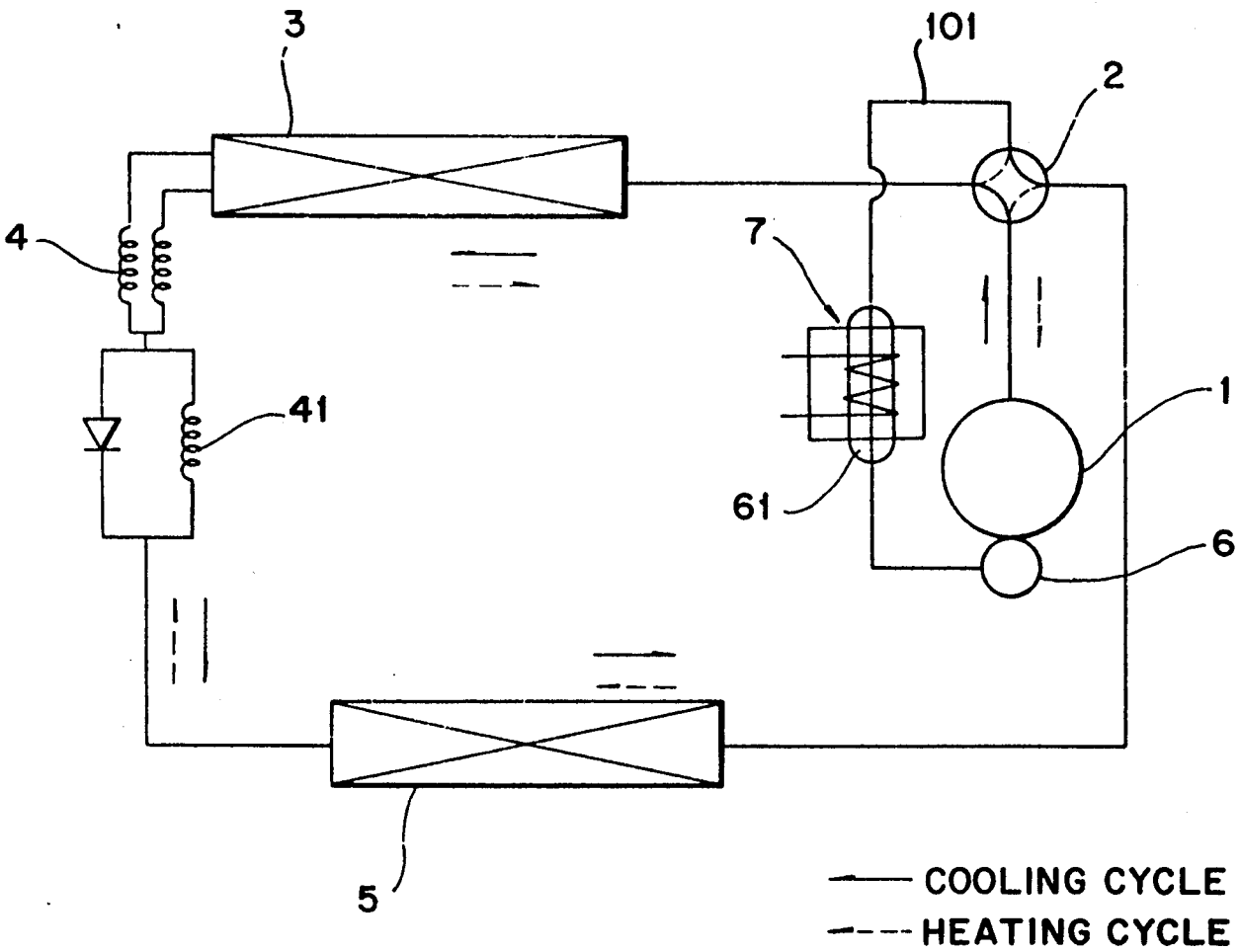
FIG. 3 is a system diagram of a cooling/heating air conditioner according to this invention.

FIG. 3 is a system diagram of a cooling/heating air conditioner according to this invention.

The cooling/heating air conditioner selectively performs either a cooling or a heating function by continuously repeating the cyclical process of compression, condensation, expansion, and evaporation.

As shown in FIG. 3, an auxiliary accumulator 61 and an auxiliary heating apparatus 7 perform their duties during the heating cycle in which refrigerant circulates in the direction of the broken line arrows.

Initially, refrigerant gas compressed to high temperature and pressure in compressor 1 is introduced via a four-way valve 2 to an indoor heat exchanger 5 where the refrigerant is heat-exchanged with indoor air, whereby the indoor heat exchanger 5 serves as a condenser in the heating cycle, and then the refrigerant is directed to expansion tubes 4 and 41 after being converted into a liquid state.

The refrigerant directed into expansion tubes 4 and 41 is expanded to a low temperature and pressure therein, and then it is directed to an outdoor heat exchanger 3.

In the outdoor heat exchanger 3 the refrigerant absorbs heat from the outdoor air which generally has a lower temperature than indoor air, and is converted into a gas state and it is then returned to the compressor 1 via the four-way valve 2, the auxiliary accumulator 61 and an accumulator 6, in that order.

As described above, during the heating cycle the cooling/heating air conditioner performs a room-heating function as the refrigerant is circulating in the reverse direction of the cooling cycle, especially with the operation of the auxiliary heating apparatus 7 mounted on the auxiliary accumulator 61.

Figure 4:
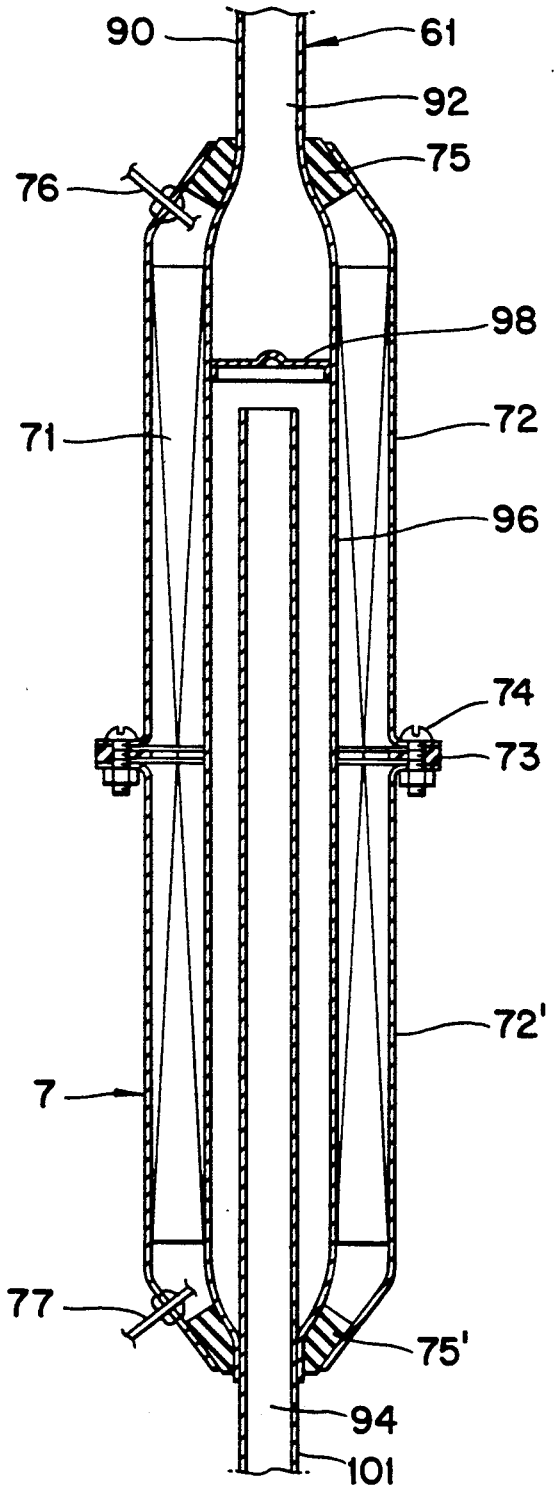
FIG. 4 is a cross-sectional view of an auxiliary accumulator and heating apparatus according to this invention.

FIG. 4 illustrates the auxiliary accumulator 61 equipped with the auxiliary heating apparatus 7 thereon.

The auxiliary accumulator 61 includes an outer pipe 90 which defines an inlet 92 of the auxiliary accumulator, and an inner pipe 101 which defines an outlet 94 of the auxiliary accumulator. The pipe 90 forms a case 96 which is much larger in diameter than the pipe 101. The pipe 101, and therefore the refrigerant pipe 101 is inserted through one end of the case 95 and is positioned so that it extends to near the opposite end of the auxiliary accumulator. Due to the above construction, the velocity of the refrigerant is reduced as it travels through the auxiliary accumulator 61. This arrangement of an inner pipe 101 disposed within an outer case 96 to form an accumulator for an air conditioning apparatus is conventional, as is the provision of a baffle plate 98 above the upper end of the inner pipe 101 for directing the refrigerant flow such that any liquid refrigerant falls between the inner tue 101 and the case 96.

The auxiliary heating apparatus 7 according to this invention comprises heating coils 71 which are wound around the peripheral surface of the auxiliary accumulator 61, and a pair of covers 72 and 72' which are mounted on the heating coils 71. Those covers constitute an upper cover 72 and a lower cover 72' which are configured to be symmetrical with respect to a midpoint of the auxiliary accumulator 61. The covers 72, 72' are laterally spaced from the refrigerant conductor portion 90, 96 to form a chamber in which the heating coils are disposed.

Sealing members 75 and 75' made of silicone material are arranged in the outer ends of the covers 72 and 72', and power cords 76, 77 electrically connected to the heating coils 71 extend from the outer ends of the covers.

The flange type inner ends of the covers 72 and 72' are fitted to each other, with a packing 73 made of rubber material sandwiched therebetween, and joined by means of several screws 74.

In the operation of this invention constructed as described above, the cooling/heating air conditioner performs a room-heating function as the refrigerant repeats the successive cycle of circulating from the compressor 1 to the indoor heat exchanger 5, the expansion tubes 4 and 41, the outdoor heat exchanger 3, and back to the compressor 1.

At this time, if the outdoor air temperature falls below a fixed value so that the refrigerant passing through the outdoor heat exchanger 3 does not absorb sufficient heat from the outdoor air, the auxiliary heating apparatus 7 is charged with electricity by signals sent from a control section to operate the heating coils 71, and then the heat emitted from the heating coils 71 is transferred to the refrigerant passing through the auxiliary accumulator 61.

It is noted that the heat transfer from the auxiliary heating apparatus 7 to the refrigerant is efficiently achieved in the auxiliary accumulator 61 because the auxiliary accumulator 61 is designed and constructed so that the speed of the refrigerant in the auxiliary accumulator 61 is reduced.

Therefore, the refrigerant which insufficiently absorbs heat in the outdoor heat exchanger 3 and which enters the auxiliary accumulator in a liquid and gas state can absorb sufficient heat in the auxiliary accumulator 61 to cause the liquid refrigerant to be changed completely into a gas state within the auxiliary accumulator 61. Then the refrigerant is returned back to the compressor 1.

What is claimed is:

1. In an air conditioning apparatus for heating and cooling, wherein refrigerant is circulated during a heating cycle through a compressor and through indoor and outdoor heat exchangers, and then through secondary and main accumulators disposed between said outdoor heat exchanger and said compressor; said secondary accumulator comprising an conductor portion elongated in a longitudinal direction and having a refrigerant inlet and a refrigerant outlet, said outlet spaced longitudinally from said inlet by a space which is wider than either of said inlet and outlet so that refrigerant travels at a reduced speed from said inlet to said outlet; a covering mounted on, and encircling, said conductor portion and being space from said conductor portion in a direction laterally with respect to said longitudinal direction to form a chamber around said conductor portion; opposite longitudinal ends of said covering being sealed against said conductor portion; electric heating coils disposed in said chamber and wound around said conductor portion along a region thereof that includes said space in order to heat refrigerant traveling at reduced speed to cause such refrigerant to evaporate.

2. Apparatus according to claim 1 wherein said covering includes upper and lower cover portions surrounding upper and lower portions of said coils, said cover portions being joined together at a midpoint of said accumulator.

* * * * *